US008684211B1

(12) United States Patent
Stammen

(10) Patent No.: US 8,684,211 B1
(45) Date of Patent: Apr. 1, 2014

(54) CAN END WITH RETORT RESISTANT PANEL, AND TOOLING AND ASSOCIATED METHOD FOR PROVIDING SAME

(75) Inventor: Dennis C. Stammen, Vandalia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 557 days.

(21) Appl. No.: 12/906,463

(22) Filed: Oct. 18, 2010

(51) Int. Cl.
*B21D 51/44* (2006.01)

(52) U.S. Cl.
USPC ..... 220/269

(58) Field of Classification Search
USPC ..... 220/269–273, 619; 72/348; 413/1, 2, 8, 413/12, 14
See application file for complete search history.

(56) References Cited

U.S. PATENT DOCUMENTS

| | | | | | |
|---|---|---|---|---|---|
| 3,490,643 | A | * | 1/1970 | McCluskey et al. | 220/273 |
| 3,762,596 | A | * | 10/1973 | Henning et al. | 220/273 |
| 4,808,052 | A | | 2/1989 | Bulso, Jr. et al. | |
| 4,955,223 | A | | 9/1990 | Stodd et al. | |
| 4,977,772 | A | | 12/1990 | Bulso, Jr. et al. | |
| 5,038,956 | A | * | 8/1991 | Saunders | 220/271 |
| 5,042,284 | A | | 8/1991 | Stodd et al. | |
| 5,331,836 | A | | 7/1994 | Cudzik | |
| 5,823,040 | A | * | 10/1998 | Stodd | 72/329 |
| D421,907 | S | | 3/2000 | Benge et al. | |
| 6,079,249 | A | | 6/2000 | Turner et al. | |
| 6,666,933 | B2 | | 12/2003 | Roberts et al. | |
| 6,702,538 | B1 | | 3/2004 | Heinicke et al. | |
| D520,358 | S | | 5/2006 | Heinicke | |
| 7,124,613 | B1 | | 10/2006 | McClung | |
| 7,143,623 | B1 | | 12/2006 | Turnbull et al. | |
| 7,270,246 | B2 | | 9/2007 | Butcher et al. | |
| 7,302,822 | B1 | | 12/2007 | Turnbull et al. | |
| 7,305,861 | B2 | | 12/2007 | Turner et al. | |
| D565,406 | S | | 4/2008 | Foskett | |
| D568,741 | S | | 5/2008 | Foskett | |
| 7,472,575 | B2 | | 1/2009 | Butcher et al. | |
| D600,117 | S | | 9/2009 | Hall | |
| D600,118 | S | | 9/2009 | Brehelin | |
| 7,614,520 | B2 | | 11/2009 | McEldowney et al. | |
| 7,677,404 | B2 | | 3/2010 | McEldowney et al. | |

* cited by examiner

*Primary Examiner* — Steven A. Reynolds
*Assistant Examiner* — King M Chu
(74) *Attorney, Agent, or Firm* — Eckert Seamans Cherin & Mallott, LLC; Grant E. Coffield; John P. Powers

(57) ABSTRACT

A can end is provided, which includes a recessed panel defined by an upwardly extending chuck wall. The panel has a product side and a public side disposed opposite the product side. A peripheral scoreline is disposed in the public side of the panel proximate to the base of the chuck wall. A tab is fastened to the panel by a rivet. The tab is operable to sever the peripheral scoreline and open the can end. An pressure resistance bead extends around the panel inboard of the peripheral scoreline and outboard of the rivet. A saw tooth panel formation disposed proximate to the pressure resistance bead inboard of the pressure resistance bead. Among other benefits, the pressure resistance bead and saw tooth panel formation combine to resist wrinkling or other undesired deformation of the can end. Tooling and a method of making the can end are also disclosed.

17 Claims, 9 Drawing Sheets

CAN END WITH RETORT RESISTANT PANEL, AND TOOLING AND ASSOCIATED METHOD FOR PROVIDING SAME

BACKGROUND

1. Field

The disclosed concept relates generally to containers and, more particularly, to can ends having retort resistant end panels. The disclosed concept also relates to tooling and associated methods for providing such can ends.

2. Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, and tab staking, are performed until the shell is fully converted into the desired can end and is discharged from the press.

In the can making industry, large volumes of metal are required in order to manufacture a considerable number of cans. Thus, an ongoing objective in the industry is to reduce the amount of metal that is consumed. Efforts are constantly being made, therefore, to reduce the thickness or gauge (sometimes referred to as "down-gauging") of the stock material from which can ends, tabs, and can bodies are made. However, as less material (e.g., thinner gauge) is used, problems arise that require the development of unique solutions. By way of example, a common problem associated with can ends for food cans is that they are subject to pressure changes associated with processing the food product within the can. More specifically, substances (e.g., without limitation, liquid; food; any other suitable substance) are commonly packaged in vacuum sealed cans. For example, a typical process for vacuum packaging food in metal cans includes filling the cans with uncooked food, sealing the can end or lid on the can and placing the can into an oven. This process is referred to as a retort process. As the food is cooked, pressure builds within the can. Then the can is cooled. Thus, the retort process induces internal (i.e., positive) pressure, followed by external (i.e., negative) pressure. The combination of the internal and external pressures induces stress on the end panel of the can end. Accordingly, for can ends and shell designs made from material having a reduced gauge or reduced blank size, such pressures and stresses tend to cause the end panel to permanently deform and/or wrinkle.

FIGS. 1A and 1B, for example, show an easy open can end 2 before (FIG. 1A) and after (FIG. 1B) the retort process. The can end 2 includes an opener (e.g., without limitation, pull tab 4), which is attached (e.g., without limitation, riveted) to a tear strip or severable panel 6. The severable panel 6 is defined by a scoreline 8 in the exterior surface 10 (e.g., public side, shown) of the can end 2. The pull tab 4 is structured to be lifted and/or pulled to sever the scoreline 8 and deflect and/or remove the severable panel 6, thereby creating an opening for dispensing the contents of the can (not shown in the top plan views of FIGS. 1A and 1B). The can end 2 in the example of FIGS. 1A and 1B is a 300 diameter end 2, and the panel 6 includes an up-panel 12 consisting of an arcuate raised area that extends outwardly from the public side 10 of the panel 6 and around the perimeter of the panel 6. As shown in FIG. 1B, the stresses caused by the internal and external pressures associated with the retort cooking process cause the panel 6 to permanently deform (e.g., without limitation, wrinkle) See, for example, the wrinkles and deformed sections generally indicated by reference 14 in FIG. 1B.

There is, therefore, room for improvement in can ends, and in tooling and methods for providing such can ends.

SUMMARY

These needs and others are met by embodiments of the disclosed concept, which are directed to a can end having a retort resistant panel, and tooling and methods for providing such can ends. Among other benefits, the unique design of the can end provides increased strength and resistance to undesirable deformation (e.g., without limitation, wrinkling) of the can end panel caused, for example, by the pressures associated with the retort cooking process, without requiring an increase in the thickness or gauge of the stock material from which the can end is made or an undesirable increase in the depth of the can end panel.

As one aspect of the disclosed concept, a can end is provided, which is structured to be affixed to a can. The can end comprises: a recessed panel defined by an upwardly extending chuck wall, the panel having a product side structured to face toward the interior of the can, and a public side disposed opposite the product side; a peripheral scoreline disposed in the public side of the panel proximate to the base of the chuck wall; a tab fastened to the panel by a rivet, the tab being operable to sever the peripheral scoreline and open the can end; a pressure resistance bead extending around the panel inboard of the peripheral scoreline and outboard of the rivet; and a saw tooth panel formation disposed proximate to the pressure resistance bead inboard of the pressure resistance bead.

The panel may include a planar portion inboard of the saw tooth panel formation, wherein the planar portion has a depth. The saw tooth panel formation may comprise a plurality of bends and a drape defined by the distance between a first one of the bends and a second adjacent one of the bends. The ratio of the depth of the panel to the drape may be from about 1:1 to about 1:4. The saw tooth panel formation may further comprise a peak, and the drape may be symmetrical on opposing sides of the peak. The saw tooth panel formation may begin proximate to one side of the tab, extend around the panel inboard of the pressure resistance bead, and end proximate to the opposite side of the tab.

Tooling and a method for making the aforementioned can end are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
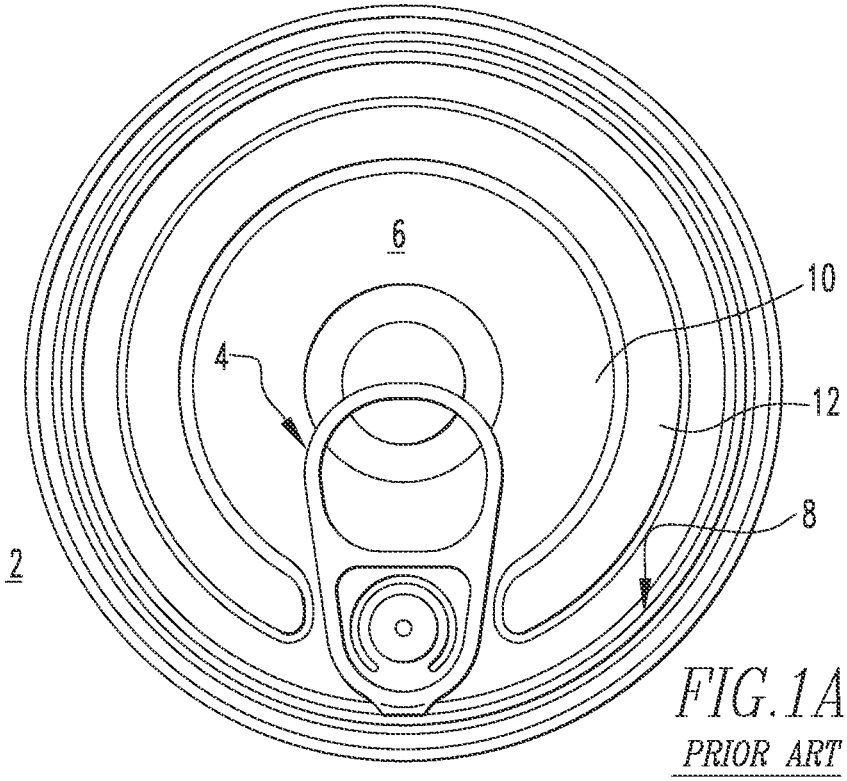
FIG.1A PRIOR ART
FIGS. 1A and 1B are top plan views of a known easy open can end before and after, respectively, undergoing the retort cooking process.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As used herein, the term "pull tab" or "tab" refers to an opening device (e.g., opener) made from generally rigid material that has undergone one or more forming and/or tooling operations, and which is structured to be suitably affixed to a can end for the purpose of being pivoted to sever a score line and open at least a portion of the can end.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
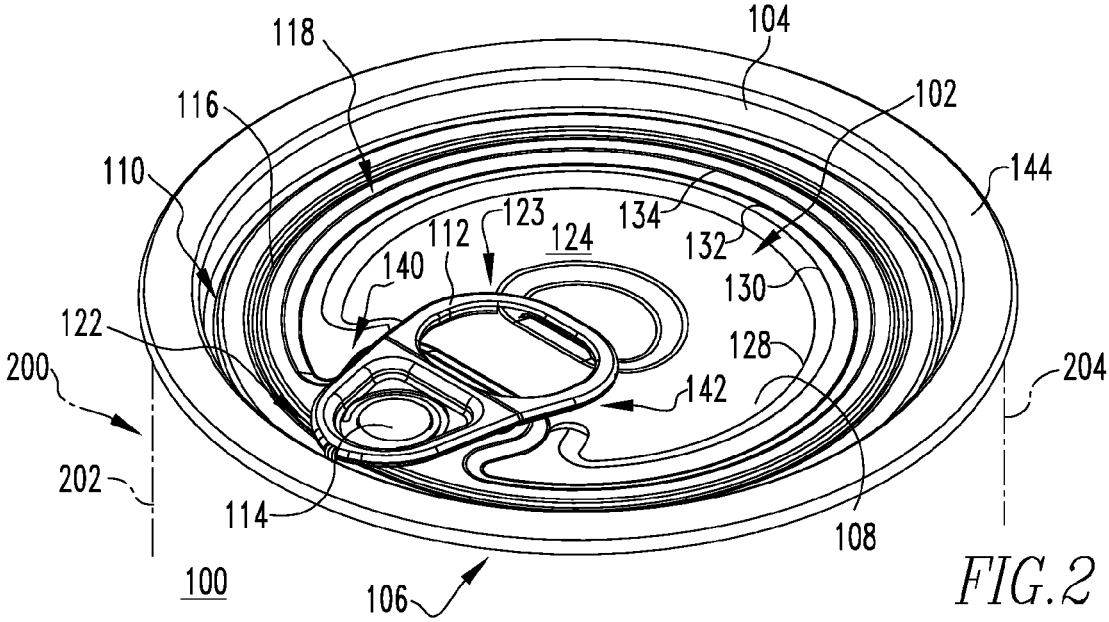
FIG. 2 is an isometric view of a can end in accordance with an embodiment of the disclosed concept.
Figure 3:
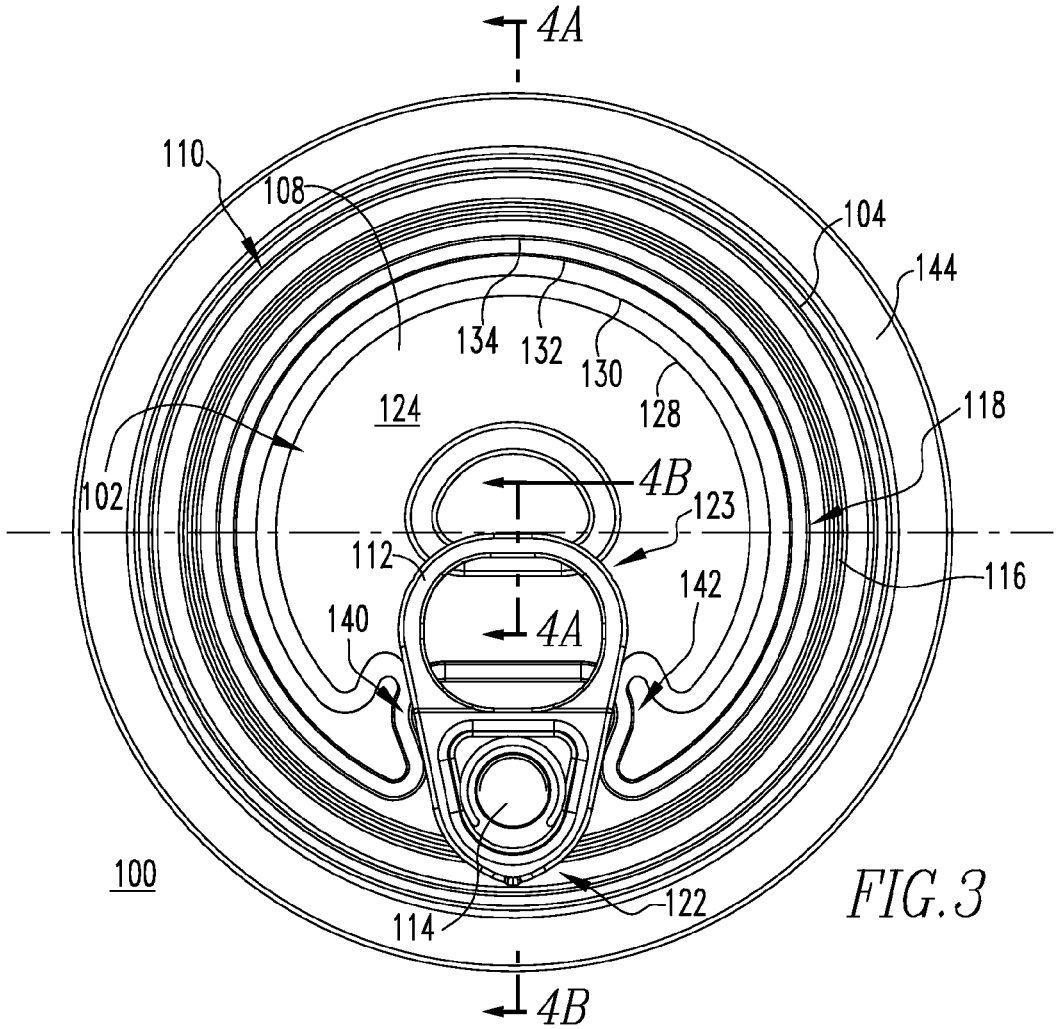
FIG. 3 is a top plan view of the can end of FIG. 2.

FIGS. 2 and 3 show a can end 100 in accordance with a non-limiting embodiment of the disclosed concept. As partially shown in phantom line drawing in FIG. 2, the can end 100 may be suitably affixed (e.g., without limitation, seamed) to a can 200.

Figure 4A:
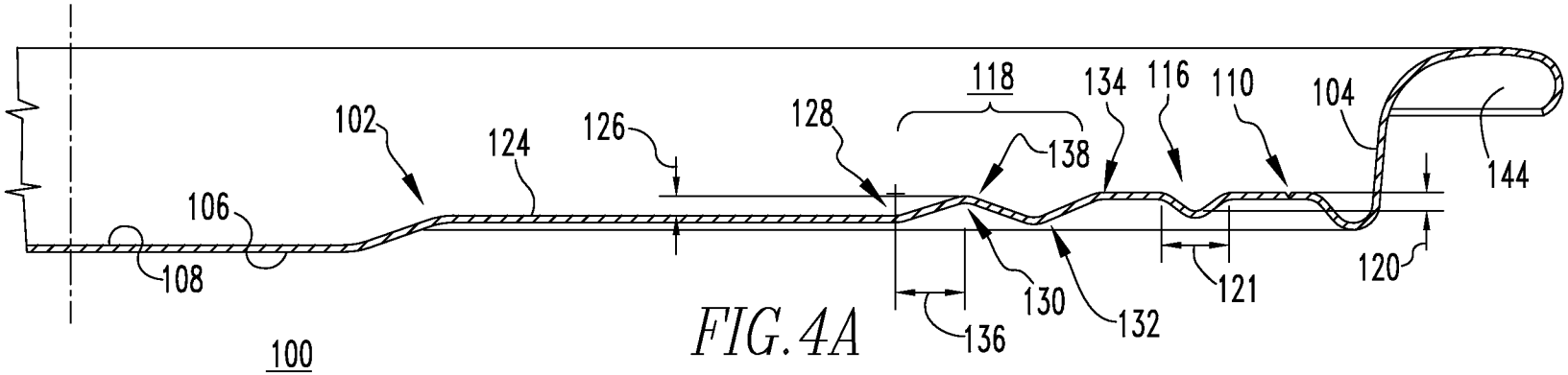
FIG. 4A is a section view taken along line 4A-4A of FIG. 3.
Figure 4B:
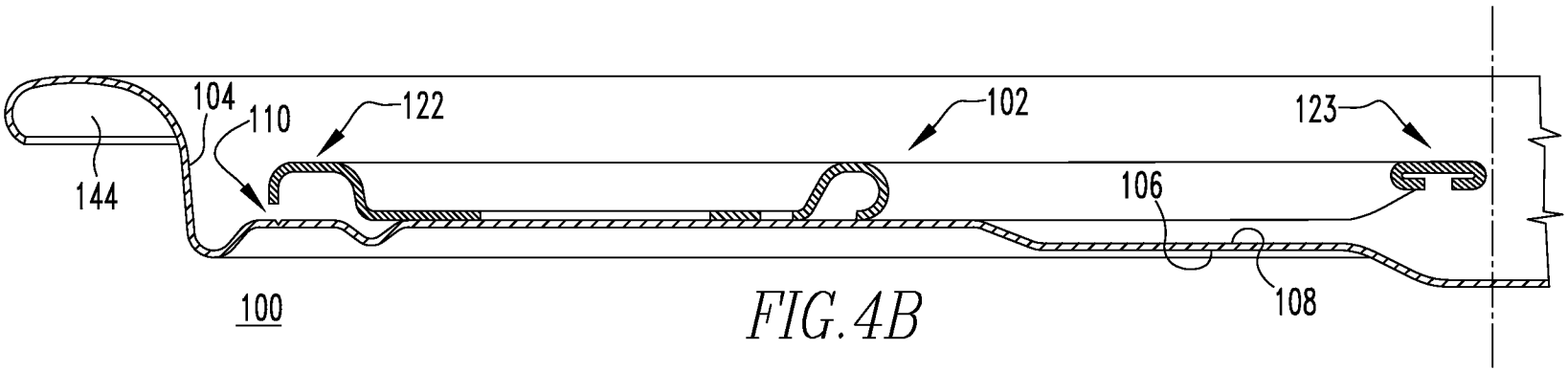
FIG. 4B is a section view taken along line 4B-4B of FIG. 3.

Continuing to refer to FIGS. 2 and 3, and also to the sectional views of FIGS. 4A and 4B, the can end 100 includes a recessed panel 102, which is defined by an upwardly extending chuck wall 104. The panel 102 has opposing product and public sides 106,108 (both shown in FIGS. 4A and 4B). A peripheral scoreline 110 is disposed on the public side 106 of the panel 102 proximate to the chuck wall 104 within the center panel radius, as best shown in FIGS. 4A and 4B. A tab 112 or other suitable opening mechanism (not shown) is fastened to the panel 102 by a rivet 114. The tab 112 is operable to sever the peripheral scoreline 110 and open the can end 100 in a generally well known manner.

Figure 1B:
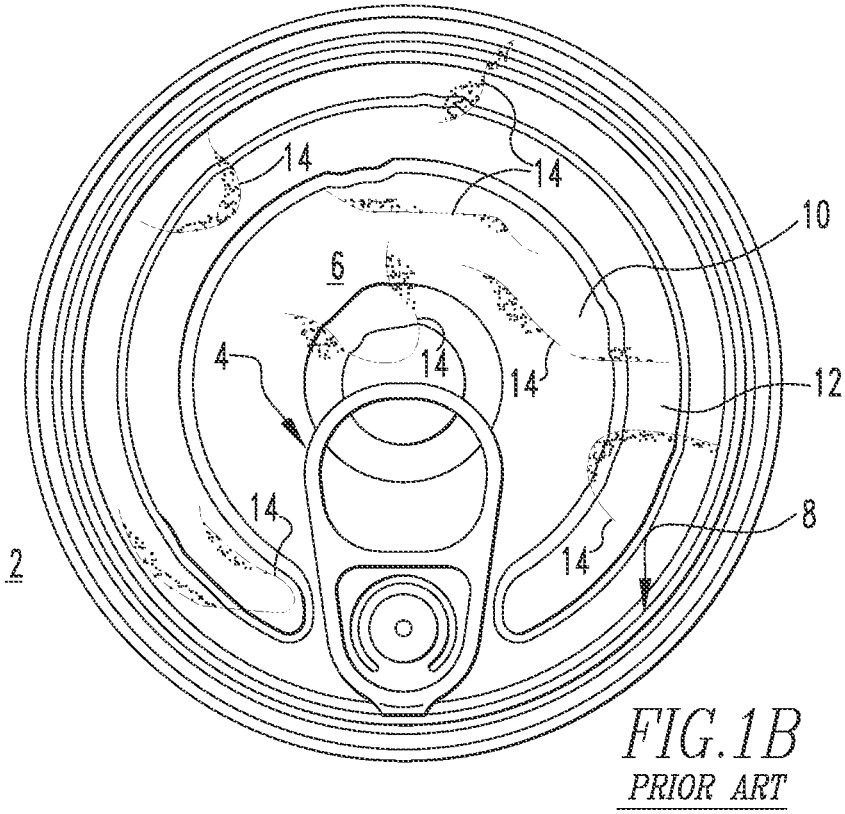
FIG.1B PRIOR ART

As previously noted hereinabove with respect to FIGS. 1A and 1B, known can ends (see, for example, can end 2 of FIGS. 1A and 1B) formed from relatively thin gauge material are known to wrinkle or otherwise undesirably deform (see, for example, wrinkled or deformed portions 14 of can end 2 of FIG. 1B) when subjected to stress such as, for example and without limitation, the stresses associated with the retort cooking process. Specifically, investigation has revealed that, for an easy open end 2 of the type shown in FIGS. 1A and 1B, the retort process induces an internal (i.e., positive) can pressure followed by an external (i.e., negative) can pressure. The combination of the internal and external pressures induce excessive stress on the can end panel 6 (FIGS. 1A and 1B) such that the panel 6 permanently deforms and/or wrinkles, as indicated generally by deformed areas 14 in FIG. 1B. Among other disadvantages, such wrinkles 14 present an aesthetic issue and are generally deemed to be unacceptable by customers.

Turning again to FIGS. 2-4B, the disclosed can end 100 overcomes the aforementioned disadvantages by incorporating a pressure resistance bead 116, which extends around the panel 102 inboard of the peripheral scoreline 110 and outward of the rivet 114, as well as a saw toothed panel formation 118, which is disposed proximate to the pressure resistance bead 116 inboard thereof. It will be appreciated, therefore, that the disclosed concept involves a completely new and unique can end panel design, which effectively distributes stresses associated with the retort cooking process to resist permanent panel deformation or wrinkling Thus, it will be appreciated, for example, that FIG. 3 is indicative of a can end 100 in accordance with the disclosed concept, both before and after the retort cooking process. In other words, the disclosed concept enables easy open can ends (e.g., 100) to be produced, without resorting to increasing the thickness or gauge of the stock material from which the can ends (e.g., 100) originate, and without requiring the depth (e.g., depth 126 of FIG. 4A) of the can end panel 102 or chuck wall depth or shell panel height to be undesirably increased. Such an increase undesirably results in increased cut edge or a larger blank diameter to make the shell. In accordance with the disclosed concept, the amount of material (e.g., without limitation, sheet metal) required to produce the can ends 100 is minimized, and the can ends 100 are cost-efficient to manufacture.

The can end 100 also includes a flange 144, which extends outwardly from the top of the chuck wall 104, and is structured to be suitably seamed to side walls 202,204 (partially shown in phantom line drawing in FIG. 2) of can 200 (partially shown in phantom line drawing in FIG. 2) or other suitable container (not shown) to secure the can end 100 thereto.

The pressure resistance bead 116 and saw tooth panel formation 118, also interchangeably refer to as a "flat" panel design because the overall height of the panel 102 does not change, will now be described in greater detail. Specifically, the pressure resistance bead 116 functions, in large part, to resist wrinkling or other deformation during the positive pressure portion of the retort cooking process cycle, and the saw tooth panel formation 118 or flat panel design, functions, in large part, to resist panel deformation during the negative pressure portion of the retort cooking process cycle. The pressure resistance bead 116 and saw tooth panel formation 118 are perhaps best shown in the enlarged section view of FIG. 4A.

Figure 7:
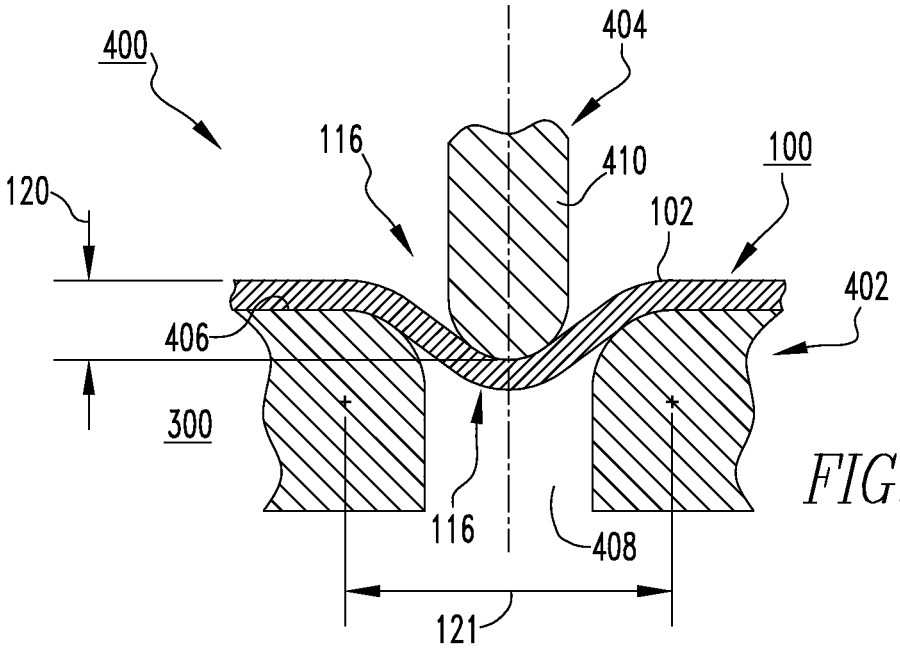
FIG. 7 is a further enlarged view of the portion of the tool assembly and can end of FIG. 6.

It will be appreciated that the non-limiting example pressure resistance bead 116 shown and described herein is provided solely for purposes of illustration and is not intended to limit the scope of the disclosed concept. For example, the bead 116 could be disposed at another suitable location on the end 100 and/or could have a different shape and/or geometry, without departing from the scope of the disclosed concept. The example pressure resistance bead 116 is a downbead. That is, it extends inwardly from the public side 108 of the can end panel 102, or outwardly from the product side 106 of the panel 102, as shown in FIG. 4A. It will be appreciated, however, that the pressure resistance bead 116 could alternatively be an upbead (not shown), which extends outwardly from the public side 108 of the can end panel 102, in the opposite direction, without departing from the scope of the disclosed concept. Preferably, the pressure resistance bead 116 has a ratio of bead height or depth 120 to width 121 of about 133:1 to about 1:1. In one non-limiting example, the pressure resistance bead 116 has a height or depth 120 from about 0.0060 inch to about 0.0200 inch, and width 121 from about 0.0820 inch to about 0.0200 inch when measured as shown in FIGS. 4A and 7. As best shown in the isometric and top plan views of FIGS. 2 and 3, respectively, the pressure resistance bead 116 extends around the can end panel 102 proximate the perimeter thereof. More specifically, the tab 112 of the can end 100 includes opposing nose and lift portions 122,123, wherein the exemplary pressure resistance bead 116 passes beneath the nose portion 122, outboard of the rivet 114, but inboard of the peripheral scoreline 110, as shown.

The geometry of the saw tooth panel formation 118, is also important to provide retort resistance. Among other unique features, the disclosed saw tooth panel formation 118 preferably includes a plurality of bends 128,130,132,134 (best shown in the side elevation sectional views of FIGS. 4A and 9), without changing the depth 126 of the planar portion 124 of the can end panel 102 disposed inboard of the saw tooth panel formation 118. In other words, bends 128 and 132 are substantially disposed in the same horizontal plane, and bends 130 and 134 are substantially disposed in the same horizontal plane, as shown in the non-limiting example of FIG. 4A. Additionally, the drape 136, or distance between a first one of the bends 128 and a second adjacent one of the bends 130, is preferably symmetrical. That is, the example saw tooth panel formation 118 includes a peak 138, defined by second bend 130, and the drape 136 is symmetrical on opposing sides of such peak 138, as shown in FIG. 4A. It will, however, be appreciated that the saw tooth panel formation 118 could have any known or suitable alternative shape, geometry, and/or configuration, without departing from the scope of the disclosed concept. For example and without limitation, it could be asymmetrical and/or the bends 128, 130,132,134 could be in different horizontal planes. In accordance with one non-limiting example, the drape 136 was about 0.075 inch. Thus, the ratio of the depth 126 of the panel 102 to the drape 136 is preferably about 1:1 to about 1:4. It will be appreciated that this is relatively high for easy open can ends, which typically have a panel depth to drape ratio of approximately 1:10. Moreover, conventional can end panels (see, for example, panel 6 of can end 2 of FIGS. 1A and 1B) do not have a symmetrical depth or drape.

It will be appreciated that the saw tooth panel formation 118 is preferably located proximate to the pressure resistance bead 116 on the outer portion of the can end 100, towards the perimeter thereof. In the example shown and described herein, the saw tooth panel formation 116 begins proximate to one side 140 of the tab 112, extends around the panel 102 inboard of the pressure resistance bead 116, and ends proximate to the opposite side 142 of the tab 112, as shown in FIGS. 2, 3 and 10F.

Tooling 300 and associated methods for making the can end 100 will now be described with reference to FIGS. 5-10F. It will be appreciated that the tooling 300 may be coupled to dies, which are in turn coupled to a conversion press in a generally well known manner. The conversion press and dies are not expressly shown herein for simplicity of illustration and economy of disclosure. It will further be appreciated that the tooling 300 and associated forming steps or processes described herein may be employed in any known or suitable number and/or configuration of tooling stations in the conversion press, where each station generally includes one or more tools and each of the tools performs a tooling operation on the material. While a limited number of stations are shown and described herein, it will be appreciated that the method of making the can end 100 in accordance with the disclosed concept could include numerous other known or suitable stations not depicted herein. It will further be appreciated that each of the stations could be located, (e.g., without limitation, housed) in separate machine housings, in a single machine housing, or in any suitable combination thereof. Finally, it will be appreciated that the stock material from which the can ends 100 are made can be conveyed through the conversion press by any known or suitable means.

Figure 10A:
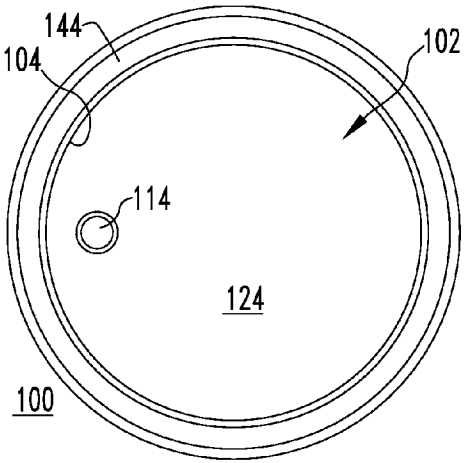
FIGS. 10A-10F are top plan views showing the sequential steps or stations for forming a can end in accordance with an embodiment of the disclosed concept.
Figure 10C:
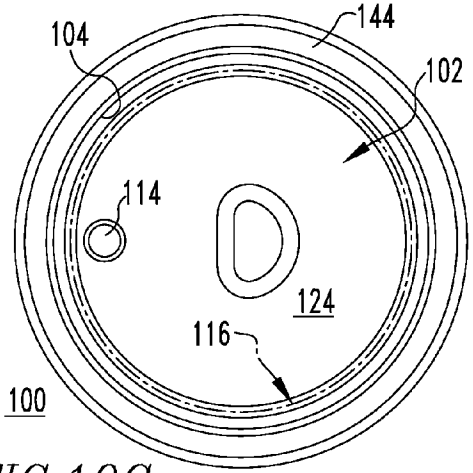
Figure 10E:
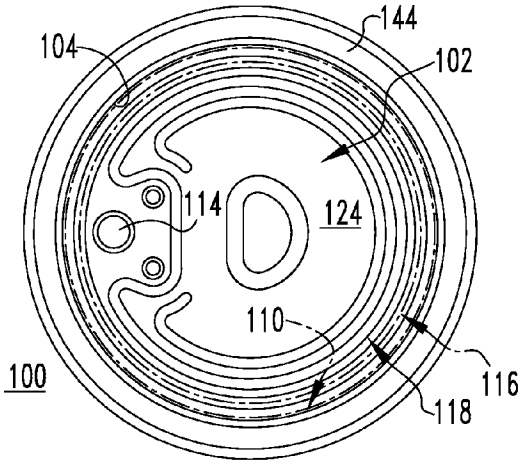
Figure 10B:
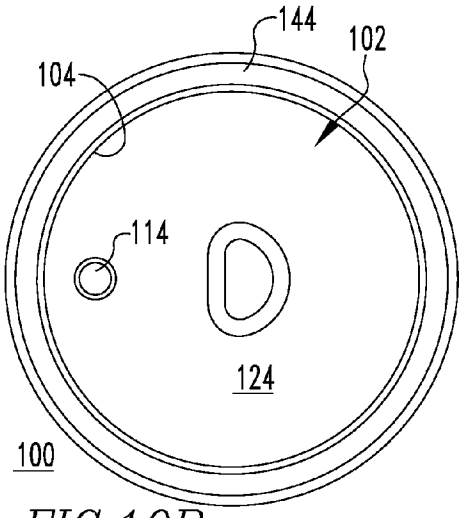
Figure 10D:
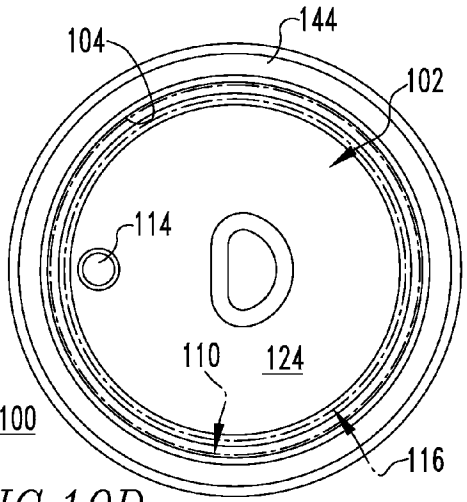
Figure 10F:
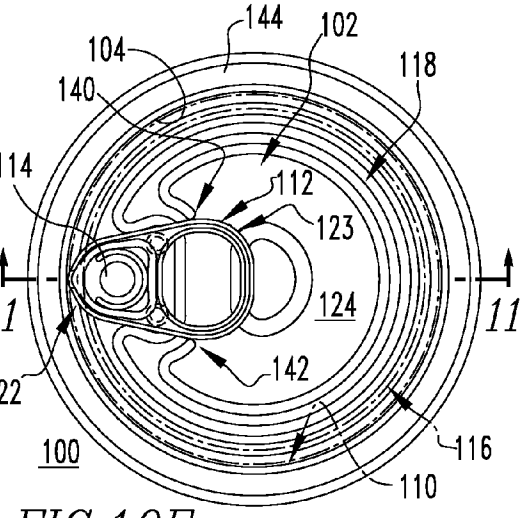

In accordance with the disclosed concept, forming the can ends 100 including pressure resistance bead 116 and saw tooth panel formation 118 generally involves up to six or more forming steps, a non-limiting example of which is sequentially depicted in FIGS. 10A-10F. Specifically, FIG. 10A illustrates a bubble form, which may occur in a first tooling station. FIG. 10B illustrates a first rivet form and finger panel process, which may be performed in a second tooling station. FIG. 10C illustrates a second rivet form and formation of the disclosed pressure resistance bead 116, which may occur in a third tooling station. FIG. 10D illustrates a third rivet form and formation of the scoreline 110, which may occur in a fourth tooling station. FIG. 10E illustrates a fourth rivet formation and formation of the disclosed saw tooth panel formation 118, which may occur in a fifth station. Finally, FIG. 10F illustrates a tab wipe down after the tab 112 has been attached to the can end 100 and the rivet 114 has been staked to secure the tab 112 thereto. Again, it will be appreciated that the aforementioned forming steps and processes, as well as the corresponding tooling stations, are provided solely for purposes of illustration in accordance with one non-limiting embodiment of the disclosed concept.

Figure 5:
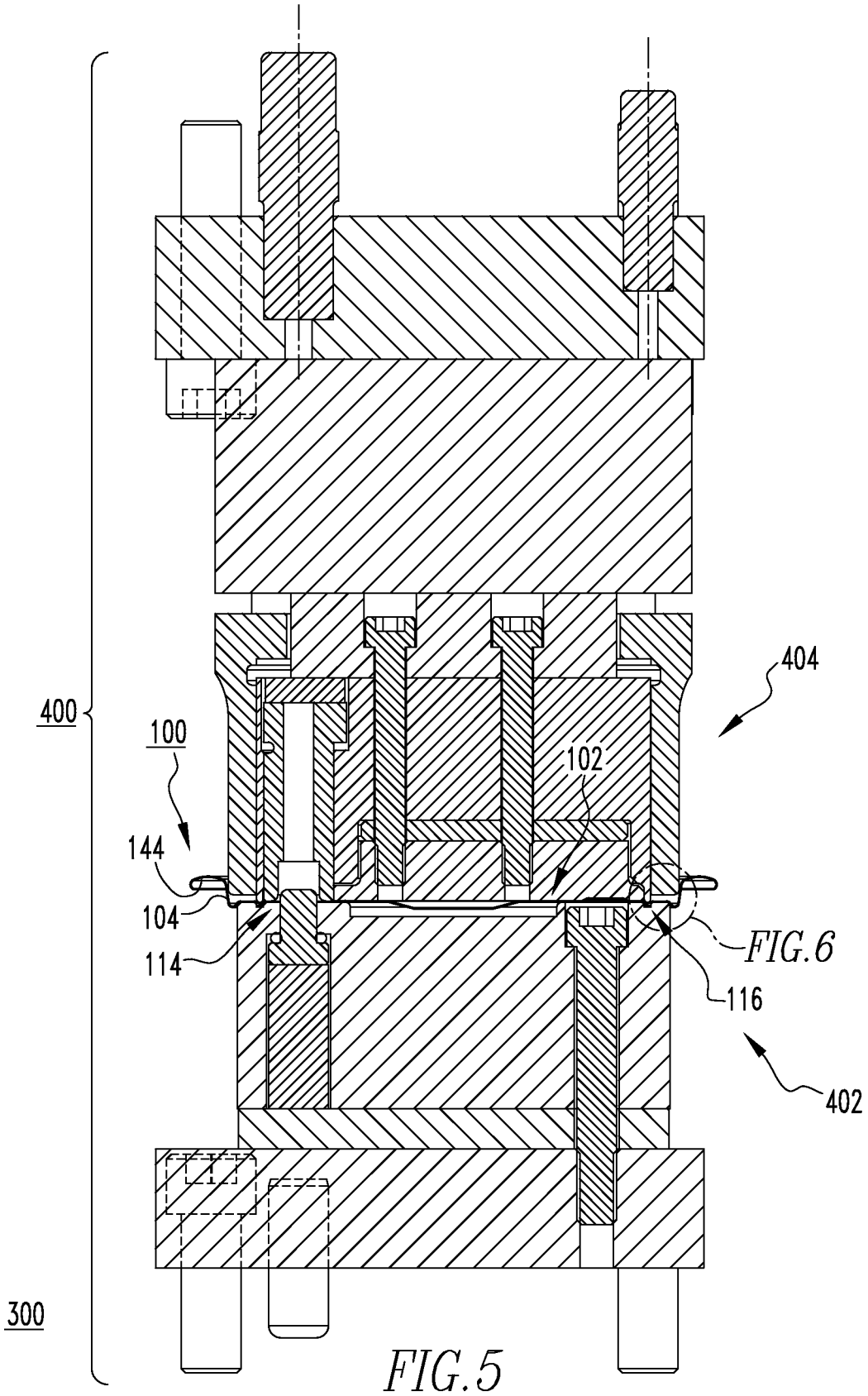
FIG. 5 is a side elevation sectional view of a tool assembly for forming a portion of a can end in accordance with an embodiment of the disclosed concept.
Figure 6:
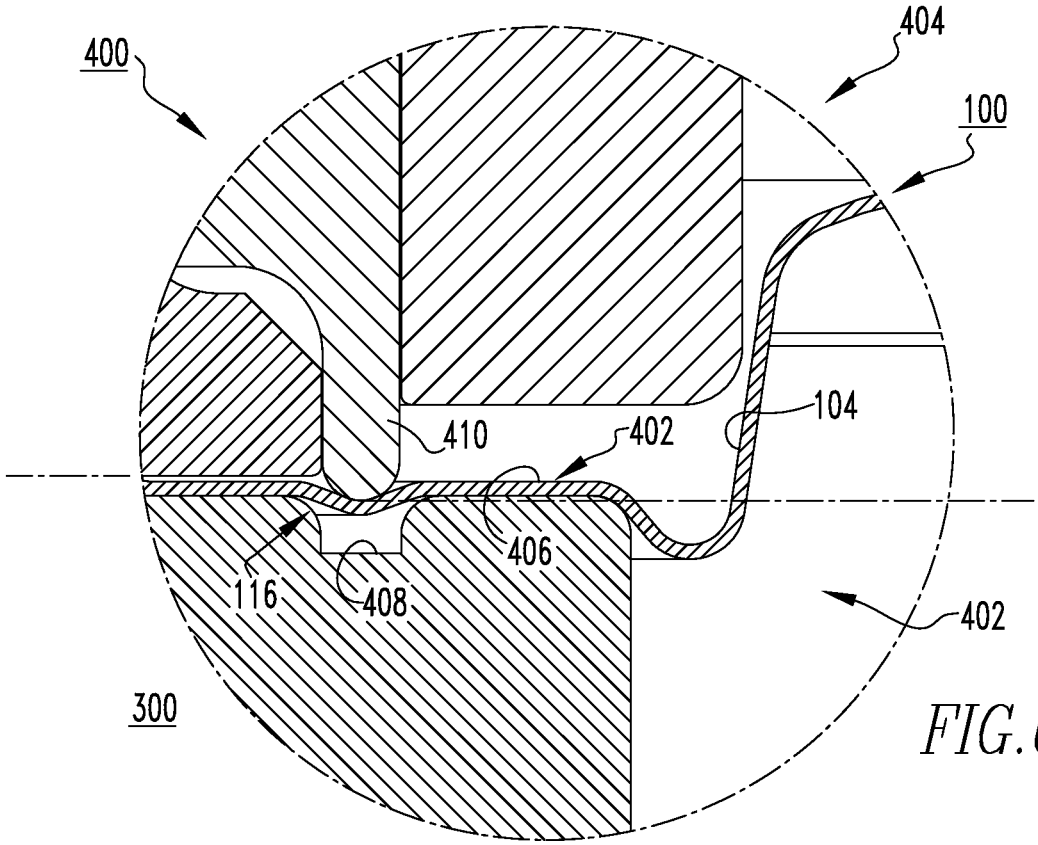
FIG. 6 is an enlarged view of a portion of the tool assembly of FIG. 5, also showing a portion of a can end being formed by such tool assembly.
Figure 8:
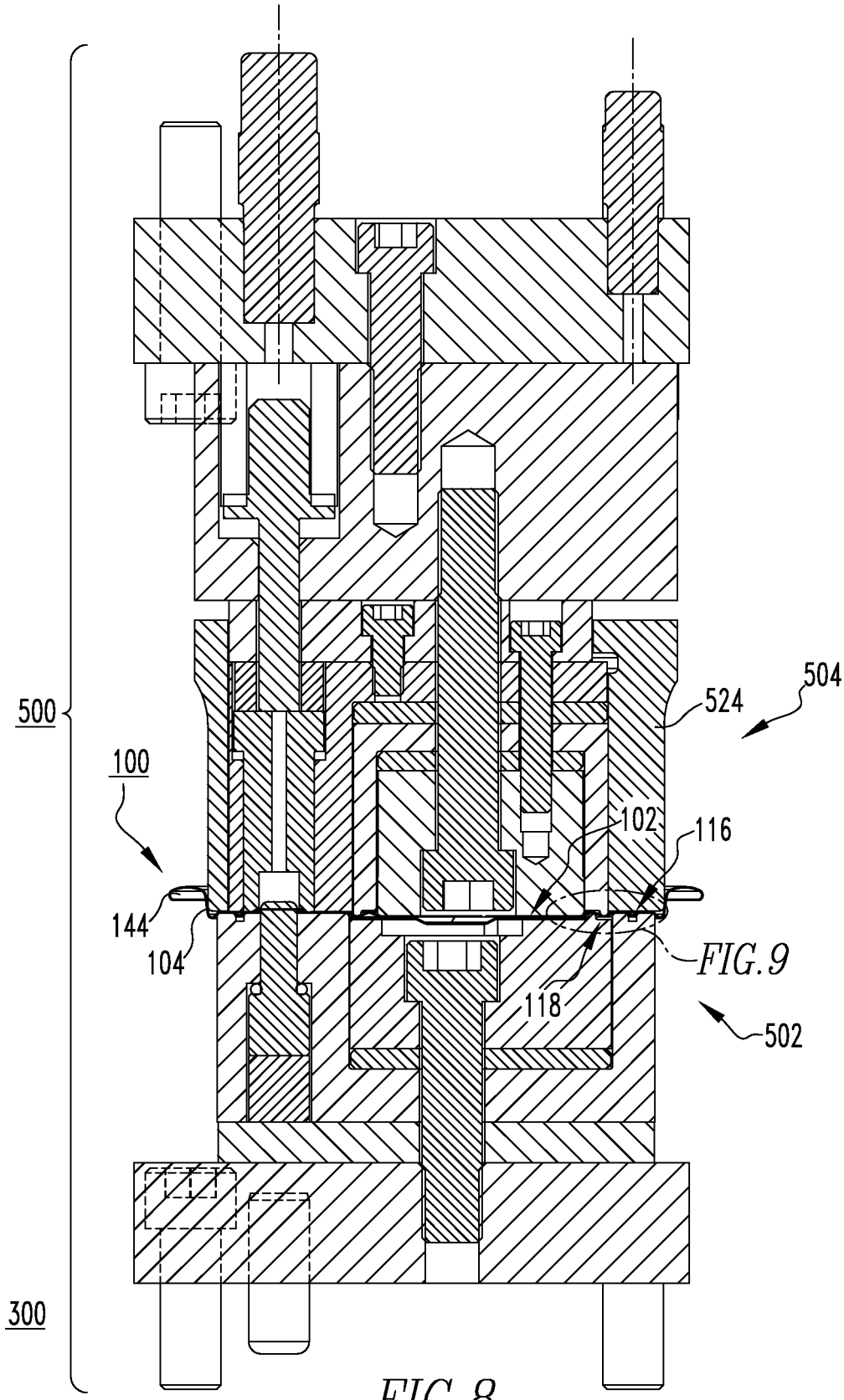
FIG. 8 is a side elevation sectional view of another tool assembly for forming another portion of the can end in accordance with an embodiment of the disclosed concept.
Figure 9:
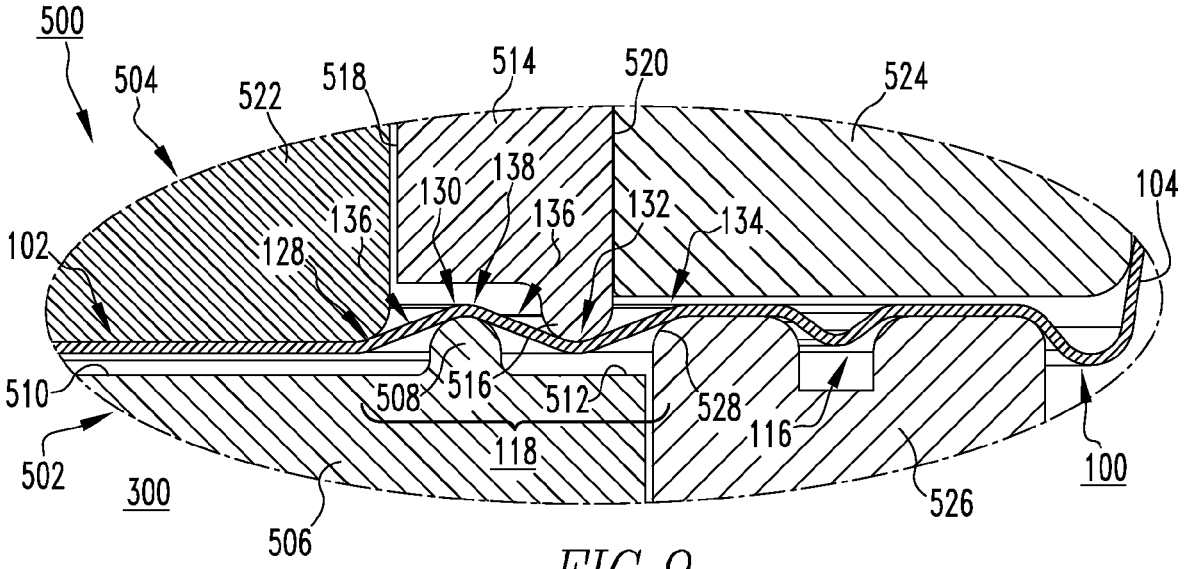
FIG. 9 is an enlarged view of a portion of the tool assembly of FIG. 8, also showing another portion of the can end being formed by such tool assembly.

The tooling assembly 400 for forming the pressure resistance bead 116 is further illustrated in FIGS. 5-7, and the tooling assembly 500 for forming the saw tooth panel formation 118 is further illustrated in FIGS. 8 and 9. Specifically, the first tool assembly 400 includes a first tool 402 and a second tool 404, which is disposed opposite the first tool 402 and is structured to cooperate with the first tool 402 to form the pressure resistance bead 116 in the panel 102, as previously described. As best shown in FIGS. 6 and 7, the first tool 402 of the example first tool assembly 400 includes a planar portion 406 and a recess 408, which extends inwardly from the planar portion 406. The second tool of the first tool assembly 400 includes a protrusion 410. The protrusion 410 is structured to extend into the recess 408. As it does so, the protrusion 410 acts upon (e.g., forms) the can end panel 102 to form the pressure resistance bead 116 therein, as best shown in FIGS. 6 and 7.

The second tooling assembly 500 includes a first tool 502 and a second tool 504 disposed opposite from the first tool 502 and structured to cooperate with the first tool 502 to form the saw tooth panel formation 118 proximate to the pressure resistance bead 116. The first tool 502 of the example second tool assembly 500 includes a forming member 506 having a projection 508, a first planar portion 510 disposed on one side of the projection 508, and a second planar portion 512 disposed on the opposite side of the projection 508, as shown in FIG. 9. The second tool 504 of the second tool assembly 500 includes a first member 514 having an offset protrusion 516, as shown. In operation, the projection 508 of the first tool 502 is structured to move toward the first member 514 of the second tool 504 as the offset protrusion 516 of the first member 514 of the second tool 504 moves toward the second planar portion 512 of the first tool 502. In this manner, a plurality of bends 128,130,132,134 are formed in the panel 102 of the can end 100 to form the desired saw tooth panel formation 118. More specifically, the first member 514 includes first and second opposing sides 518,520, and the second tool 504 includes a second member 522 movably disposed on the first side 518, and a third member 524 movably disposed on the second side 520. The first tool 502 further includes a supporting member 526 movably disposed beside the forming member 506. The supporting member 526 includes a shoulder 528, as shown. Accordingly, as illustrated in FIG. 9, in operation, the third member 524, which in the example shown and described herein is a spring-loaded clamping member, cooperates with the supporting member 526 to support the pressure resistance bead 116. Then, the second member 522 cooperates with (e.g., without limitation, moves toward) the first planar portion 510 of the first tool 502 to form the first bend 128 of the saw tooth panel formation 118, the projection 508 of the first tool 502 forms the second bend 130 of the saw tooth panel formation 118, the offset protrusion 516 of the first member 514 of the second tool 504 forms the third bend 132 of the saw tooth panel formation 118, and the shoulder 528 of the supporting member 526 forms the fourth bend 134 of the saw tooth panel formation 118.

Figure 11:
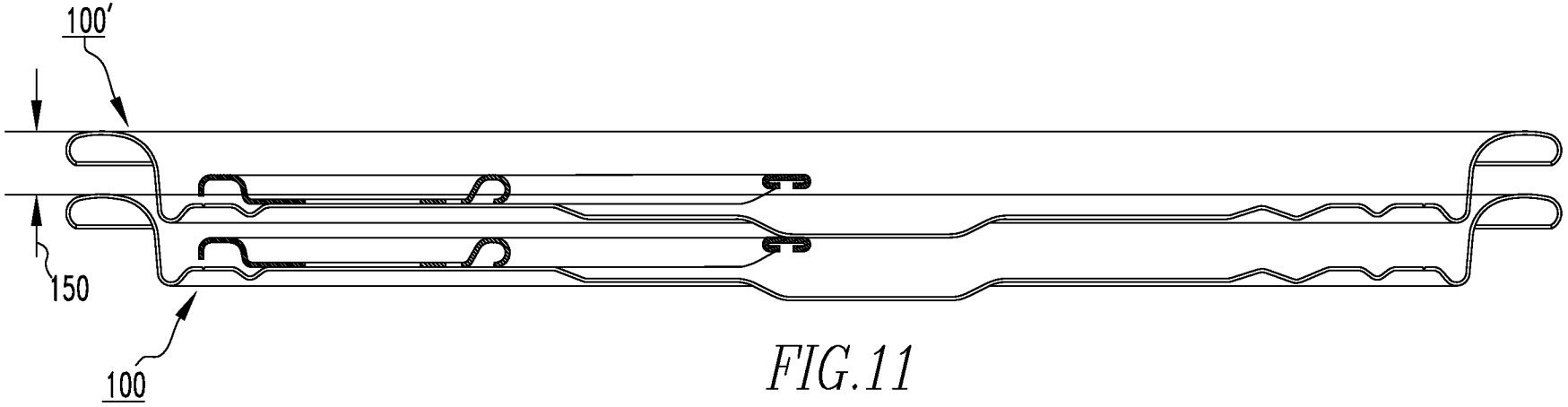
FIG. 11 is a side elevation section view of a pair of finished can ends stacked one on top of the other.

FIG. 11 illustrates a pair of finished can ends 100,100', formed in accordance with the aforementioned tooling and method, and stacked one on top of the other. In accordance with one non-limiting embodiment of the disclosed concept, the stack height 150 when the can ends 100,100' are stacked, as shown, is about 0.027 inch. It will be appreciated, however, the can ends (e.g., without limitation, 100,100') could have any known or suitable alternative stack height (e.g., without limitation, 150) or other stacking characteristic, without departing from the scope of the disclosed concept.

Accordingly, the disclosed concept provides a can end 100 having an entirely different end panel design for resisting wrinkling or other deformation caused, for example and without limitation, by pressures and stresses associated with the retort cooking process. Specifically, the can end panel 102 incorporates a pressure resistance bead 116 and a unique saw tooth panel formation 118, to distribute and accommodate the positive and negative pressures and associated stresses caused by the retort process. Thus, a cost-effective can end 100 is provided, which can be produced using a minimal amount of material (e.g., without limitation, sheet metal) while affording enhanced resistance to undesirable permanent deformation.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A can end structured to be affixed to a can, the can end comprising:

a recessed panel defined by an upwardly extending chuck wall, the panel having a product side structured to face toward the interior of the can, and a public side disposed opposite the product side;

a peripheral scoreline disposed in the public side of the panel proximate to the base of the chuck wall;

an annular countersink formed between the peripheral scoreline and the base of the chuck wall, the annular countersink extending upwardly and inwardly from the base of the chuck wall toward the peripheral scoreline;

a tab fastened to the panel by a rivet, the tab being operable to sever the peripheral scoreline and open the can end;

a pressure resistance bead extending around the panel inboard of the annular countersink and the peripheral scoreline and outboard of the rivet; and a saw tooth panel formation disposed proximate to the pressure resistance bead inboard of the pressure resistance bead;

wherein the tab includes a nose portion and a lift portion disposed opposite and distal from the nose portion; and wherein the pressure resistance bead passes beneath the nose portion.

2. The can end of claim 1 wherein the pressure resistance bead has a depth; and wherein the depth is from 0.0060 inch to 0.0200 inch.

3. The can end of claim 1 wherein the panel includes a planar portion inboard of the saw tooth panel formation; wherein the planar portion has a depth; wherein the saw tooth panel formation comprises a plurality of bends and a drape defined by the distance between a first one of the bends and a second adjacent one of the bends; and wherein the ratio of the depth of the panel to the drape is from 1:1 to 1:4.

4. The can end of claim 3 wherein the saw tooth panel formation further comprises a peak; and wherein the drape is symmetrical on opposing sides of the peak.

5. The can end of claim 1 wherein the pressure resistance bead is a downbead extending inwardly from the public side of the panel and outwardly from the product side of the panel.

6. The can end of claim 1 in combination with a can; wherein the can includes side walls; wherein the can end further comprises a chime seam extending outwardly from the top of the chuck wall; and wherein the chime seam is seamed to the side walls to secure the can end to the can.

7. The can end of claim 1 wherein the saw tooth panel formation begins proximate to one side of the tab, extends around the panel inboard of the pressure resistance bead, and ends proximate to the opposite side of the tab.

8. The can end of claim 1 wherein the panel includes a planar portion disposed between the pressure resistance bead and the saw tooth panel formation.

9. A can end structured to be affixed to a can, the can end comprising:

a recessed panel defined by an upwardly extending chuck wall, the panel having a product side structured to face toward the interior of the can, and a public side disposed opposite the product side;

a peripheral scoreline disposed in the public side of the panel proximate to the base of the chuck wall;

an annular countersink formed between the peripheral scoreline and the base of the chuck wall, the annular countersink extending upwardly and inwardly from the base of the chuck wall toward the peripheral scoreline;

a tab fastened to the panel by a rivet, the tab being operable to sever the peripheral scoreline and open the can end;

a pressure resistance bead extending around the panel inboard of the annular countersink and the peripheral scoreline and outboard of the rivet; and a saw tooth panel formation disposed proximate to the pressure resistance bead inboard of the pressure resistance bead;

wherein the saw tooth panel formation begins proximate to one side of the tab, extends around the panel inboard of the pressure resistance bead, and ends proximate to the opposite side of the tab.

10. The can end of claim 9 wherein the panel includes a planar portion disposed between the pressure resistance bead and the saw tooth panel formation.

11. The can end of claim 9 wherein the pressure resistance bead has a depth; and wherein the depth is from 0.0060 inch to 0.0200 inch.

12. The can end of claim 9 wherein the tab includes a nose portion and a lift portion disposed opposite and distal from the nose portion; and wherein the pressure resistance bead passes beneath the nose portion.

13. The can end of claim 9 wherein the panel includes a planar portion inboard of the saw tooth panel formation; wherein the planar portion has a depth; wherein the saw tooth panel formation comprises a plurality of bends and a drape defined by the distance between a first one of the bends and a second adjacent one of the bends; and wherein the ratio of the depth of the panel to the drape is from 1:1 to 1:4.

14. The can end of claim 13 wherein the saw tooth panel formation further comprises a peak; and wherein the drape is symmetrical on opposing sides of the peak.

15. The can end of claim 9 wherein the pressure resistance bead is a downbead extending inwardly from the public side of the panel and outwardly from the product side of the panel.

16. The can end of claim 9 in combination with a can; wherein the can includes side walls; wherein the can end further comprises a chime seam extending outwardly from the top of the chuck wall; and wherein the chime seam is seamed to the side walls to secure the can end to the can.

17. A can end structured to be affixed to a can, the can end comprising:

a recessed panel defined by an upwardly extending chuck wall, the panel having a product side structured to face toward the interior of the can, and a public side disposed opposite the product side;

a peripheral scoreline disposed in the public side of the panel proximate to the base of the chuck wall;

an annular countersink formed between the peripheral scoreline and the base of the chuck wall, the annular countersink extending upwardly and inwardly from the base of the chuck wall toward the peripheral scoreline;

a tab fastened to the panel by a rivet, the tab being operable to sever the peripheral scoreline and open the can end;

a pressure resistance bead extending around the panel inboard of the annular countersink and the peripheral scoreline and outboard of the rivet; and a saw tooth panel formation disposed proximate to the pressure resistance bead inboard of the pressure resistance bead;

wherein the recessed panel includes a planar portion disposed between the pressure resistance bead and the saw tooth panel formation.

* * * * *